US007077561B2

(12) United States Patent
Streiff et al.

(10) Patent No.: US 7,077,561 B2
(45) Date of Patent: Jul. 18, 2006

(54) ASSEMBLY OF CROSSING ELEMENTS AND METHOD OF CONSTRUCTING SAME

(75) Inventors: Felix A. Streiff, Oberes Guetli 1 (CH); Robert E. McMillen, Wichita, KS (US)

(73) Assignee: Sulzer Chemtech AG, Winterthur (CH)

( * ) Notice: Subject to any disclaimer, the term of this patent is extended or adjusted under 35 U.S.C. 154(b) by 147 days.

(21) Appl. No.: 10/619,688

(22) Filed: Jul. 15, 2003

(65) Prior Publication Data

US 2004/0125691 A1 Jul. 1, 2004

Related U.S. Application Data

(60) Provisional application No. 60/395,885, filed on Jul. 15, 2002.

(51) Int. Cl.
*B01F 5/06* (2006.01)

(52) U.S. Cl. ..... 366/337; 366/338

(58) Field of Classification Search ..... 366/181.5, 366/337, 338; 138/38, 40, 42
See application file for complete search history.

(56) References Cited

U.S. PATENT DOCUMENTS

| | | | | |
|---|---|---|---|---|
| 3,190,618 | A * | 6/1965 | Katzen | |
| 3,743,250 | A * | 7/1973 | Fitzhugh et al. | |
| 3,827,676 | A * | 8/1974 | Brasie | |
| 4,008,072 | A * | 2/1977 | Kuhn et al. | |
| 4,072,296 | A | 2/1978 | Doom | |
| 4,093,188 | A | 6/1978 | Horner | |
| 4,826,089 | A * | 5/1989 | Psaltopoulos | |
| 5,941,637 | A * | 8/1999 | Maurer | |
| 6,164,813 | A * | 12/2000 | Wang | |
| 6,394,644 | B1 * | 5/2002 | Streiff | |
| 6,595,679 | B1 * | 7/2003 | Schuchardt | |
| 6,623,155 | B1 * | 9/2003 | Baron | |
| 6,769,801 | B1 * | 8/2004 | Maurer et al. | 366/337 |
| 2001/0012235 | A1 * | 8/2001 | Schuchardt | |
| 2004/0114461 | A1 * | 6/2004 | Fuglister | 366/337 |
| 2004/0125691 | A1 * | 7/2004 | Streiff et al. | |

FOREIGN PATENT DOCUMENTS

| | | | |
|---|---|---|---|
| CH | 627263 | A5 * | 12/1981 |
| DE | 4428813 | A1 * | 2/1996 |
| DE | 19755905 | C1 * | 5/1999 |
| EP | 1 067 352 | A | 1/2001 |
| FR | 2863696 | A1 * | 6/2005 |
| GB | 2061746 | A * | 5/1981 |
| GB | 2236089 | A * | 3/1991 |
| WO | 98/47791 | * | 10/1998 |
| WO | 2004/007063 | A1 * | 1/2004 |
| WO | 2004/060542 | A1 * | 7/2004 |

* cited by examiner

OTHER PUBLICATIONS

Koch-Glitsch, Inc. "Laminar Flow Static Mixing—Design and Scaleup Criteria" by Chris F. Meyer, dated Oct. 1991.

*Primary Examiner*—Charles E. Cooley
(74) *Attorney, Agent, or Firm*—Hovey Williams LLP

(57) ABSTRACT

A static mixer (10) is provided with a first grid (14) having one or more crossing elements (16) and one or more slots and a second grid (14) having one or more crossing elements (16) and one or more slots. The crossing elements (16) of the first grid (14) are arranged at intersecting angles to the crossing elements (16) of the second grid (14). At least one elongated connector (18) is positioned between and secured to adjacent crossing elements (16) of the first grid (14) and crossing elements (16) of the second grid (14). The grids may further be arranged such that each crossing element of one grid intersects a slot in the other grid.

46 Claims, 6 Drawing Sheets

ASSEMBLY OF CROSSING ELEMENTS AND METHOD OF CONSTRUCTING SAME

CROSS-REFERENCE TO RELATED APPLICATIONS

This application claims the benefit of U.S. Provisional Application Ser. No. 60/395,885 filed on Jul. 15, 2002.

BACKGROUND OF THE INVENTION

The present invention relates to mixing elements and methods and, more particularly, to an assembly of crossing elements such as found in static mixers and heat exchangers and to a method of constructing same.

Static mixing elements are positioned in tubes or other fluid flow conduits to cause mixing of one or more fluid stream flowing within the conduit or to cause simultaneous mixing of a product fluid stream and heat exchange between the product fluid stream and a service fluid separated from the product fluid stream by a wall and flowing in co-current or countercurrent relationship. The fluid streams include polymer melts and other highly viscous fluids in laminar flow and low viscosity liquids or gases in turbulent flow applications. These static mixing elements typically have no moving parts and operate by radial transport of the fluid stream and dividing the fluid stream into multiple partial streams which are then recombined to reduce cross sectional variations in composition, temperature or other properties of the fluid stream. In types of static mixing elements generally known as SMX, SMXL, SMV and SMR mixers, two or more grids of crossing elements are arranged at intersecting angles to each other and at an angle to the longitudinal axis of the conduit. The crossing elements, which are corrugated plates in the case of SMV mixers, bars in the case of SMX and SMXL mixers, and rods or tubes in the case of SMR mixers, are spaced apart within each grid and crossing elements from the paired grid are interposed within the spacing. In order to achieve good mixing, the crossing elements are normally placed closely together so that there is no, or only a little, gap between adjacent elements.

Static mixers as described above are often used for enhancing the heat transfer between a service fluid and a product fluid stream separated from the service fluid by a conduit wall. In the case of SMV, SMX and SMXL type mixers, the crossing elements are inserted in a jacketed pipe or inside the tubes of a multi-tube heat exchanger. The service fluid then flows outside of jacket or shell and the mixing and heat transfer with the product fluid stream flowing within the pipe or tubes is enhanced by the crossing elements. In the case of SMR mixers, the bars in the crossing elements are replaced by tubes arranged in multiple, parallel tube grid. The service fluid flows within the tubes and the product fluid stream flows outside the tubes and is mixed while simultaneously undergoing heat exchange with the service fluid.

One problem with static mixers using grids of crossing elements of the types described above is the difficulty in making them strong enough to withstand the pressure drop caused by viscous fluids, such as polymers, flowing through the mixers. The crossing elements must also be secured to the flow conduit and those crossing elements secured to the conduit must withstand the stresses applied to the other crossing elements. In many applications, such as fiber coolers, the SMR tubes must additionally withstand a high outside pressure.

In order to withstand these stresses, the crossing elements must have a rugged design involving very thick materials and reinforcing components, such as welding the crossing elements together at their crossing points. In the case of SMR type mixers, it is known to additionally weld tabs between each adjacent loop of tubing within each tube array. The tabs are normally the same thickness as the tube wall and up to three rows of tabs are placed in each tube array. A typical SMR tube bundle may consist of eight to more than forty such tube arrays and, as a result, more than two thousand tabs might be required for a typical SMR tube bundle. It can be appreciated that welding or otherwise securing these tabs to the tubes is extremely labor-intensive and can add considerably to the cost of the tube bundle.

A significant need has thus developed for an improved method of reinforcing the above-described crossing elements.

SUMMARY OF THE INVENTION

In one aspect, the invention is directed to a static mixer with a first grid having one or more crossing elements and one or more slots adjacent to each crossing element and a second grid having one or more crossing elements and one or more slots adjacent to each crossing element. The crossing elements of the first grid are arranged at intersecting angles to said crossing elements of said second grid. At least one elongated connector is positioned between and secured to the crossing elements of the first and second grid. The grids may be arranged such that each crossing element of one grid intersects a slot in the other grid.

In another aspect, the invention is directed to a method of constructing the static mixer described above. The invention is also directed to a static mixer assembly.

BRIEF DESCRIPTION OF THE DRAWING

In the accompanying drawings which form part of the specification and are to be read in conjunction therewith and in which like reference numerals are used to indicate like parts in the various views.

DETAILED DESCRIPTION OF THE INVENTION

Figure 1A:
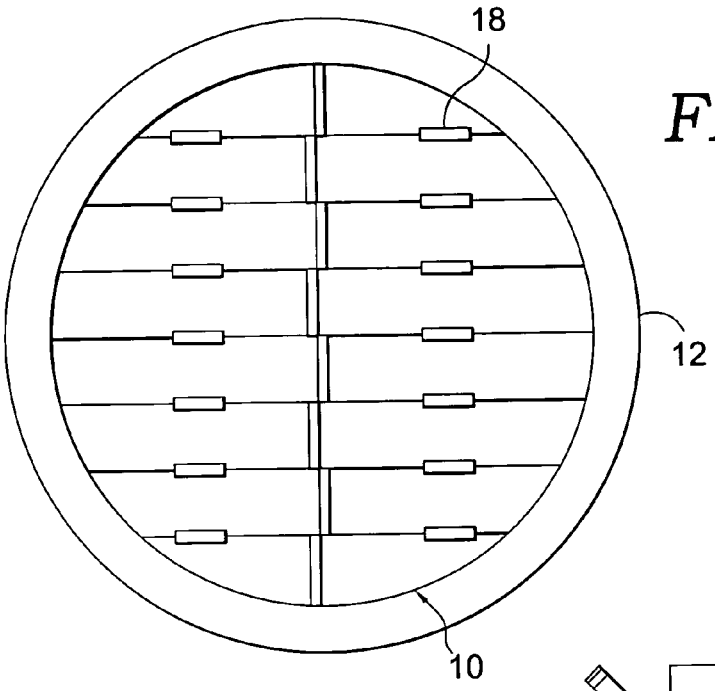
FIG. 1A comprises a top plan view of an SMX type static mixer constructed in accordance with the present invention.
Figure 1B:
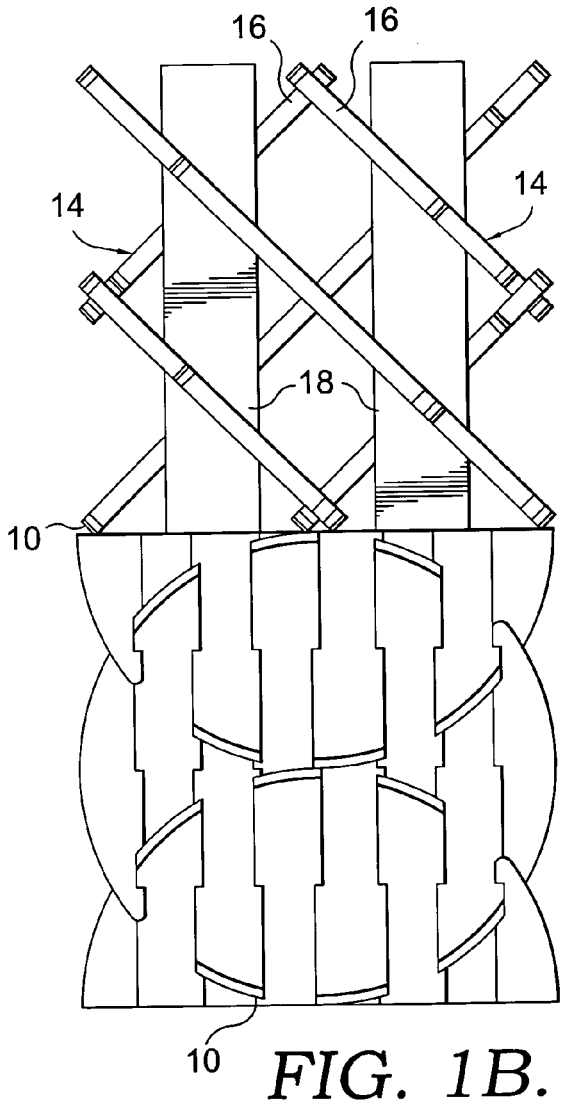
FIG. 1B comprises a side elevation view of an SMX type static mixer constructed in accordance with the present invention.
Figure 2:
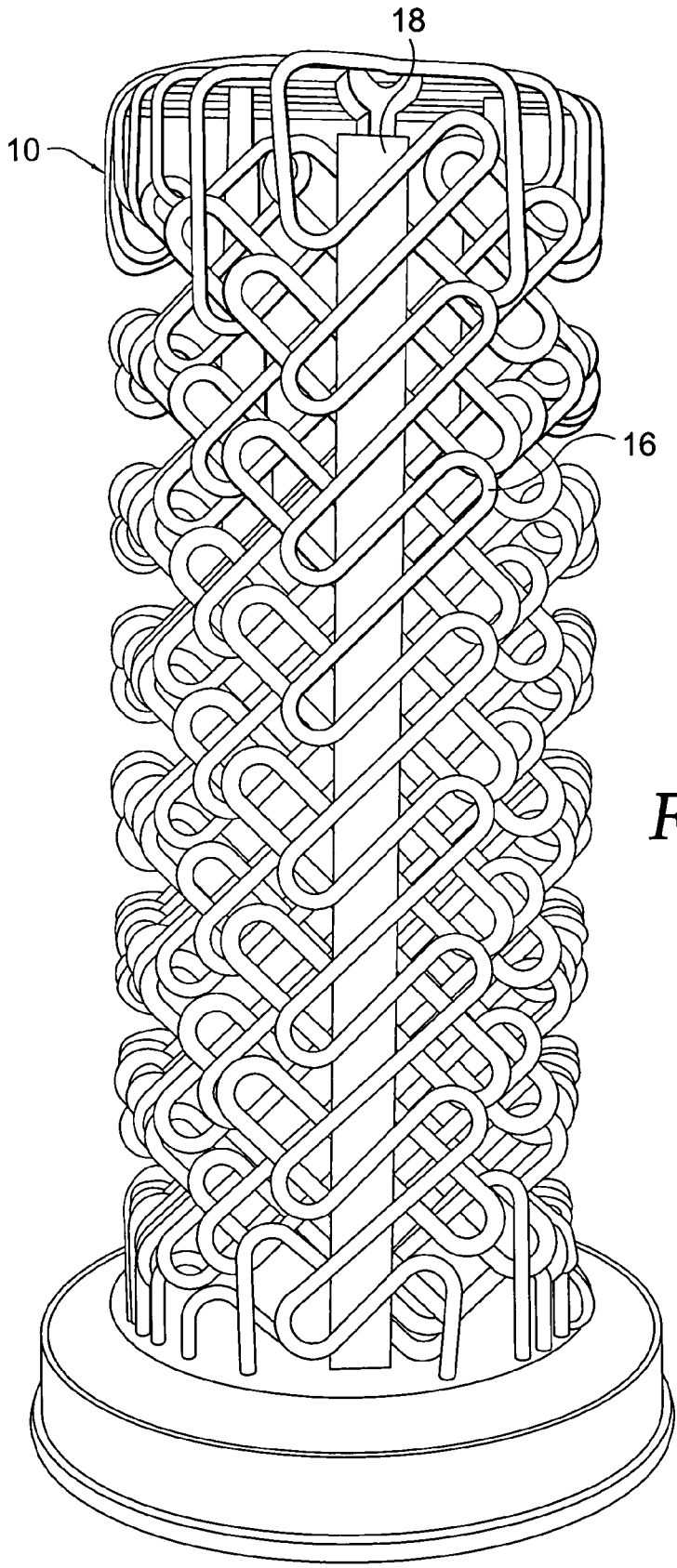
FIG. 2 is a side elevation view of an SMR static mixer of the present invention.
Figure 3:
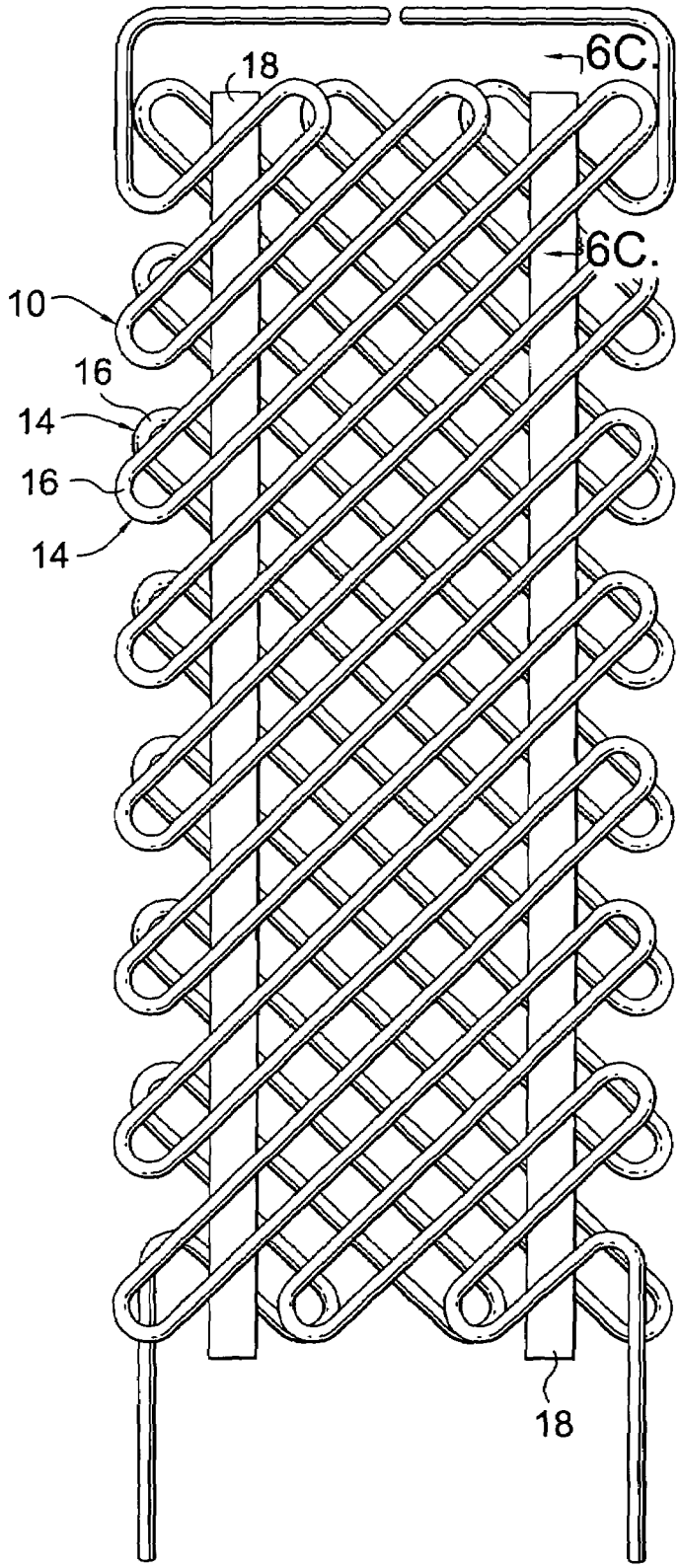
FIG. 3 is an enlarged fragmentary side elevation view of a portion of the SMR static mixer shown in FIG. 2.
Figure 6A:
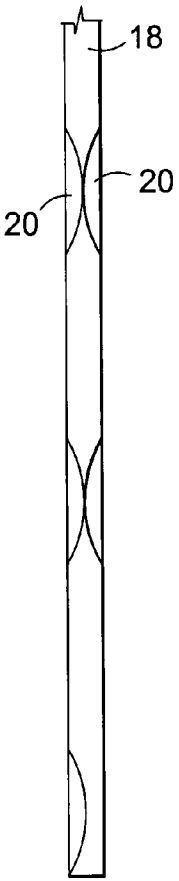
FIG. 6A is a side plan view of a connector and taken along line 6A—6A of FIG. 5A.
Figure 5A:
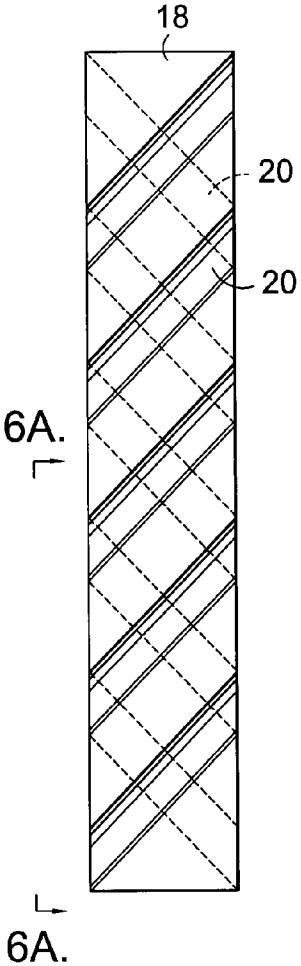
FIG. 5A is a view of a connector of the present invention.
Figure 4:
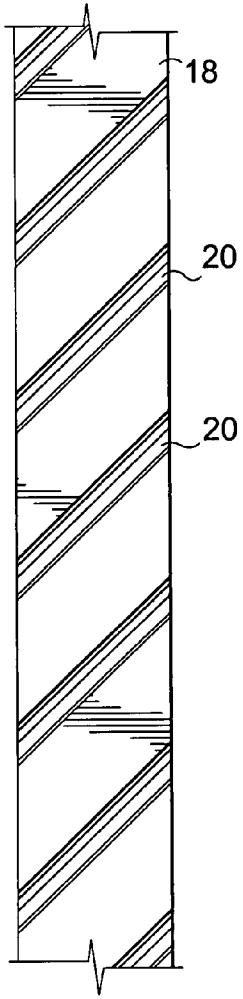
FIG. 4 is a view of a connector of the present invention.
Figure 6C:
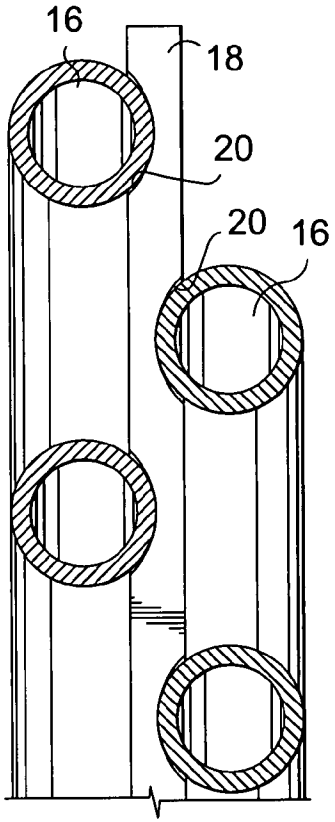
FIG. 6C is side plan view of a connector and connecting elements and taken along line 6C—6C of FIG. 3.
Figure 6B:
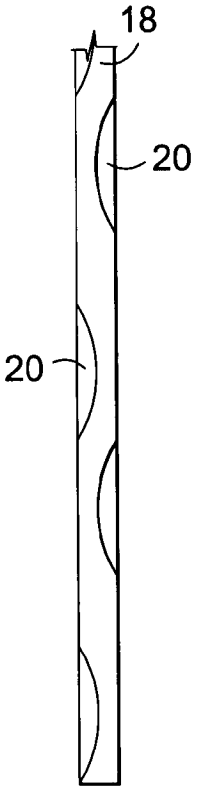
FIG. 6B is a side plan view of a connector and taken along line 6B—6B of FIG. 5B.
Figure 5B:
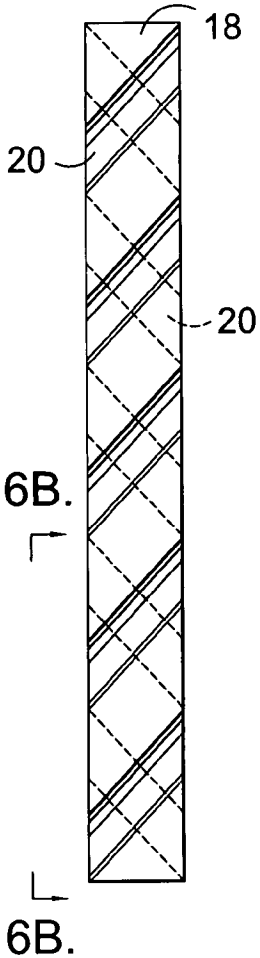
FIG. 5B is a view of a connector of the present invention.

Referring now to the drawings in greater detail, the present invention is directed to a static mixer 10 which is used by positioning within a pipe or other completely or partially enclosed fluid flow conduit 12 to mix or otherwise reduce cross sectional variations in composition, temperature or other properties of one or more fluid streams flowing within the conduit 12. The static mixer 10 may also be used to cause heat exchange between a product fluid stream and a service fluid flowing co-currently or countercurrently and separated from the product fluid stream by a wall. An SMX type static mixer 10 is illustrated in FIG. 1 and portions of an SMR type static mixer are illustrated in FIGS. 2–3.

The static mixer 10 comprises two or more grids 14 of crossing elements 16 and slots adjacent to each crossing element 16. The crossing elements 16 are arranged at intersecting angles to each other and at an inclination angle to a longitudinal axis of the fluid flow conduit 12. For example, intersecting angles of 60 and 90 degrees and inclination angles of 30 and 45 degrees can be used. The grids are arranged such that each crossing element of one grid intersects a slot in the other grid. The crossing elements 16 within each grid 14 preferably, but not necessarily, extend parallel to each other and lie within a common plane. The crossing elements 16 can be in the form of corrugated plates as in the case of an SMV static mixer 10, bars as in the case of the SMX static mixer 10 shown in FIG. 1, and tubes as in the case of the SMR static mixer 10 shown in FIGS. 2–3. Plates, rods and other structures that function to cause splitting and recombining of the fluid stream flowing within the conduit 12 can also be used as the crossing elements 16. In the case of tubes, one or more fluid streams also flow within the tubes, such as for heat exchange with the fluid stream flowing outside of the tubes. In addition to the illustrated SMX and SMR static mixers, the invention is applicable to static mixers commonly known by the name SMXL and any other mixer types having inclined and crossing elements of any shape.

In accordance with the present invention, an elongated connector 18 is positioned between and secured to the adjacent crossing elements 16 from each paired grid 14. When multiple paired grids 14 are utilized, the connector 18 preferably extends continuously along the entire cross-sectional length of the static mixer 10 and joins together the adjacent crossing elements 16 in each of the multiple grids 14. The connector 18 is preferably a flat bar as illustrated in FIGS. 4–6C, but can also be a rod or other structure. The connector 18 is made of material having the necessary rigidity and composition for joining to the crossing elements 16. For example, when the crossing elements 16 are made of metal, the connector 18 is preferably a compatible metal. When the crossing elements 16 are of polymeric or ceramic construction, the connector 18 is preferably of similar construction.

The connector 18 is preferably positioned so that it intersects with the crossing elements 16 along at least some of their points of intersection. Multiple connectors 18 extending in parallel and spaced apart relationship may also be used.

The connector 18 should be of a relatively thin construction to minimize the flow restriction between adjacent crossing elements 16. Preferably, however, the connector 18 is formed of thicker material for added strength and includes crossing grooves 20 positioned along the lines of contact of the crossing elements 16 with the connector 18. The grooves 20 in one face of the connector 18 extend in parallel relationship to each other and at an angle to the grooves 20 formed in the opposite face of the connector 18. The thickness of the connector 18 at the crossing points of the grooves 20, if present, is preferably very small or zero. The grooves 20 thus serve to reduce the spacing between adjacent crossing elements 16 while facilitating attachment of the crossing elements 16 to the connector 18 by providing a larger bonding surface and mechanical fitting for holding the crossing elements 16 together. The grooves 20 can be formed in any suitable fashion, such as by removing material from the connector 18 or by forming the grooves during fabrication of the connector 18, for example during casting or injection molding of the connector 18.

As but one example, when the connector 18 is used with tubular crossing elements 16 such as present in an SMR static mixer 10, the connector 18 is 30 mm wide and 5 mm thick and has grooves 20 that are contoured to complementally receive the tubular crossing elements 16. Thus, if the tubes in the crossing elements 16 have a diameter of 13.5 mm, the grooves 20 will have half moon shape corresponding to a pipe diameter of approximately 14 mm. The depth of this half moon groove 20 is preferably 2.5 to 3 mm in order to allow a zero gap between the crossing elements 16, but it can also be of a smaller dimension to allow some distance of separation between the crossing elements 16.

Figure 7:
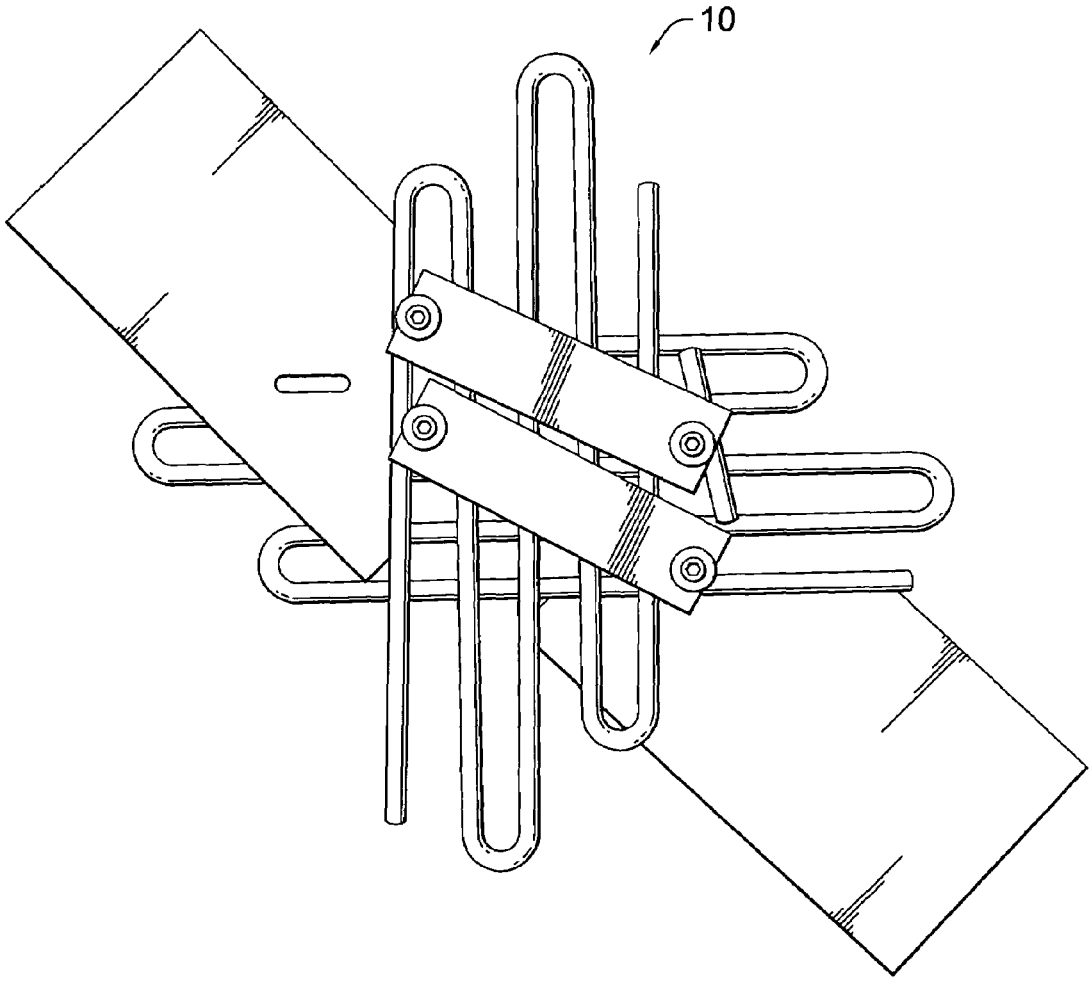
FIG. 7 is a side elevation view illustrating the clamping of adjacent tube arrays during a method of construction of the present invention.

The crossing elements 16 are fixed to the connector 18 by welding, brazing, gluing or other suitable techniques in a step-wise or continuous fashion. For example, the connector 18 can be initially joined to the adjacent crossing elements 16 by clamping as shown in FIG. 7 or by tag welding. After a structure of two or more layers of crossing elements 16 are fixed in this manner, the grooves 20 are filled with brazing material, such as nickel braze in a paste or sheet form. The entire assembly is then placed in a vacuum oven for heat treatment and brazing at a suitable temperature, such as 1050° C. Alternatively, other brazing methods may be used, as well as full or partial welding, gluing or other means of attachment.

Notably, the load on each crossing element 16 resulting from the pressure drop of the fluid stream flowing around the crossing elements 16 is transferred to the connector 18 rather than to the next crossing element 16 as is the case with the conventional construction and reinforcement method using tabs. Test samples have shown that the tubular crossing elements 16 can take a load of at least 30 kN if the connector 18 is 30 mm wide and 5 mm thick and is secured using the brazing procedure described above. This strength far exceeds the load of 0.5 to 1 kN that is typically experienced for a pressure drop of 20 to 40 bar across a static mixer made of twenty tube grids with fifteen inclined tubes in each grid.

The connector 18 can also be used as the support structure for the whole assembly by fixing it to the inlet or outlet flange or body, thereby eliminating the need for expensive supports between tube bundles or mixing elements.

Having thus described the invention, what is claimed is:

1. A static mixer comprising:

a first grid comprising one or more crossing elements and one or more slots adjacent to each crossing element and a second grid comprising one or more crossing elements and one or more slots adjacent to each crossing element, wherein said crossing elements of said first grid are arranged at intersecting angles to said crossing elements of said second grid; and at least one elongated connector positioned between and secured to said crossing elements of said first grid and said crossing elements of said second grid, wherein said connector has crossing grooves positioned along the lines of contact of said crossing elements with said connector, wherein said grooves provide a larger bonding surface and mechanical fitting for holding said crossing elements together.

2. The static mixer of claim 1, wherein said grids are arranged such that each crossing element of one grid intersects a slot in the other grid.

3. The static mixer of claim 2, wherein said crossing elements of said first grid are in a generally parallel relationship relative to one another.

4. The static mixer of claim 3, wherein said crossing elements of said first grid lie within a common plane.

5. The static mixer of claim 4, wherein said crossing elements of said second grid are in generally parallel relationship relative to one another.

6. The static mixer of claim 5, wherein said crossing elements of said second grid lie within a common plane.

7. The static mixer of claim 1, wherein said crossing elements are one of corrugated plates and tubes.

8. The static mixer of claim 1, wherein the static mixer comprises more than two grids.

9. The static mixer of claim 8, wherein each grid comprises crossing elements.

10. The static mixer of claim 9, wherein said crossing elements of each grid are arranged at intersecting angles to one another.

11. The static mixer of claim 10, wherein said connector is positioned between said crossing elements of each grid.

12. The static mixer of claim 1, wherein said crossing elements are one of metal, polymeric, ceramic construction or combinations thereof.

13. The static mixer of claim 1, wherein said connector extends continuously along the entire cross-sectional length of said static mixer.

14. The static mixer of claim 1, wherein said elongated connector is positioned so that it intersects with said crossing elements along at least some of their points of intersection.

15. The static mixer of claim 1, wherein said grooves are located in a first face of said connector and extend in relationship to said crossing elements of said first grid and wherein said grooves are located in a second face of said connector and extend in relationship to said crossing elements of said second grid.

16. The static mixer of claim 1, wherein said crossing elements are secured to said connector by one of welding, brazing, gluing and combinations thereof.

17. A method of constructing a static mixer, said method comprising:

(a) providing at least two grids;

(b) positioning one or more crossing elements and one or more slots adjacent to each crossing element in a first grid;

(c) positioning one or more crossing elements and one or more slots adjacent to each crossing element in a second grid;

(d) arranging said crossing elements of said first grid at intersecting angles to said crossing elements of said second grid;

(e) positioning at least one connector between said crossing elements of said first grid and said crossing elements of said second grid, wherein said connector has crossing grooves positioned along the lines of contact of said crossing elements with said connector, wherein said grooves provide a larger bonding surface and mechanical fitting for holding said crossing elements together; and (f) securing said connector to said crossing elements.

18. The method of claim 17, further comprising:

arranging said grids such that each crossing element of one grid intersects a slot in the other grid.

19. The method of claim 18, further comprising:

providing more than two grids.

20. The method of claim 19, further comprising:

positioning one or more crossing elements in each grid.

21. The method of claim 20, further comprising:

arranging said crossing elements of each grid at intersecting angles to one another.

22. The method of claim 21, further comprising:

positioning said connector between said crossing elements of each grid.

23. A static mixer assembly comprising:

a generally ring-shaped fluid flow conduit having a central axis, concentric inner and outer, radially spaced, circumferentially extending surfaces, said inner surface defining a fluid flow path which extends along said axis;

one or more static mixers located in said flaw path, each static mixer having a first grid comprising one or more crossing elements and one or more slots adjacent to each crossing element and a second grid comprising one or more crossing elements and one or more slots adjacent to each crossing element, wherein said crossing elements of said first grid are arranged at intersecting angles to said crossing elements of said second grid; and at least one elongated connector positioned between and secured to said crossing elements of said first grid and said crossing elements of said second grid, wherein said connector has crossing grooves positioned along the lines of contact of said crossing elements with said connector, wherein said grooves provide a larger bonding surface and mechanical fitting for holding said crossing elements together.

24. The static mixer assembly of claim 23, wherein said grids are arranged such that each crossing element of one grid intersects a slot of the other grid.

25. A static mixer comprising:

a first grid comprising at least two spaced crossing elements and one or more slots positioned between and adjacent to said crossing elements and a second grid comprising at least two spaced crossing elements and one or more slots positioned between and adjacent to said crossing element, wherein said crossing elements of said first grid are arranged at intersecting angles to said crossing elements of said second grid, and wherein said grids are arranged such that each crossing element of one grid intersects and a slot in the other grid; and multiple elongated connectors positioned between and secured to said crossing elements of said first grid and said crossing elements of said second grid.

26. The static mixer of claim 25, wherein said crossing elements of said first grid are in a generally parallel relationship relative to one another.

27. The static mixer of claim 26, wherein said crossing elements of said first grid lie within a common plane.

28. The static mixer of claim 27, wherein said crossing elements of said second grid are in generally parallel relationship relative to one another.

29. The static mixer of claim 28, wherein said crossing elements of said second grid lie within a common plane.

30. The static mixer of claim 25, wherein said crossing elements are one of corrugated plates and tubes.

31. The static mixer of claim 25, wherein the static mixer comprises more than two grids.

32. The static mixer of claim 31, wherein each grid comprises crossing elements.

33. The static mixer of claim 32, wherein said crossing elements of each grid are arranged at intersecting angles to one another.

34. The static mixer of claim 33, wherein said connectors extend in parallel and spaced apart relationship to each other and are positioned between said crossing elements of each grid.

35. The static mixer of claim 25, wherein said crossing elements are one of metal, polymeric, ceramic construction or combinations thereof.

36. The static mixer of claim 25, wherein said connectors extends continuously along the entire cross-sectional length of said static mixer.

37. The static mixer of claim 25, wherein said elongated connectors are positioned so that they intersects with said crossing elements along at least some of their points of intersection.

38. The static mixer of claim 25, wherein each of said connectors has crossing groves positioned along the lines of contact of said crossing elements with said connector, wherein said grooves provide a larger bonding surface and mechanical fitting for holding said crossing elements together.

39. The static mixer of claim 38, wherein said grooves are located in a first face of each of said connectors and extend in relationship to said crossing elements of said first grid and wherein said grooves are located in a second face of each of said connectors and extend in relationship to said crossing elements of said second grid.

40. The static mixer of claim 25, wherein said crossing elements are secured to said connectors by one of welding, brazing, gluing and combinations thereof.

41. A method of constructing a static mixer, said method comprising:

(a) providing at least two grids;

(b) positioning at least two spaced crossing elements and one or more slots between and adjacent to each crossing element in a first grid;

(c) positioning at least two spaced crossing elements and one or more slots between and adjacent to each crossing element in a second grid;

(d) arranging said crossing elements of said first grid at intersecting angles to said crossing elements of said second grid;

(e) arranging said grids such that each crossing element of one grid intersects a slot in the other grid;

(f) positioning multiple parallel and spaced apart one connectors between said crossing elements of said first grid and said crossing elements of said second grid; and (g) securing said connectors to said crossing elements.

42. The method of claim 41, further comprising:

providing more than two grids.

43. The method of claim 42, further comprising:

positioning one or more crossing elements in each grid.

44. The method of claim 42, further comprising:

arranging said crossing elements of each grid at intersecting angles to one another.

45. The method of claim 44, further comprising:

positioning said connectors between said crossing elements of each grid.

46. A static mixer assembly comprising:

a generally ring-shaped fluid flow conduit having a central axis, concentric inner and outer, radially spaced, circumferentially extending surfaces, said inner surface defining a fluid flow path which extends along said axis;

one or more static mixers located in said flow path, each static mixer having a first grid comprising at least two spaced crossing elements and one or more slots positioned between and adjacent to each crossing element and a second grid comprising at least two spaced crossing elements and one or more slots positioned between and adjacent to each crossing element, wherein said crossing elements of said first grid are arranged at intersecting angles to said crossing elements of said second grid, and wherein said grids are arranged such that each crossing element of one grid intersects a slot of the other grid; and multiple elongated connectors extending in parallel and spaced apart relationship and positioned between and secured to said crossing elements of said first grid and said crossing elements of said second grid.

* * * * *